United States Patent [19]

Lindabury et al.

[11] Patent Number: 4,987,523

[45] Date of Patent: Jan. 22, 1991

[54] ADJUSTABLE BEAM FOCUS FLASHLIGHT

[75] Inventors: Bruce W. Lindabury, R.D. 3, Box 6, Newton, N.J. 07860; Ralph J. DeVito, Stanhope, N.J.

[73] Assignee: Bruce Wayne Lindabury, Newton, N.J.

[21] Appl. No.: 486,111

[22] Filed: Feb. 28, 1990

[51] Int. Cl.[5] ..... F21L 7/00

[52] U.S. Cl. ..... 362/188; 362/306

[58] Field of Search ..... 362/187, 188, 205, 306

[56] References Cited

U.S. PATENT DOCUMENTS

| | | | |
|---|---|---|---|
| 1,584,539 | 5/1926 | Hopkins | 362/188 |
| 1,608,195 | 11/1926 | Barany | 362/188 |
| 1,668,382 | 5/1928 | Roffy | 362/188 |
| 1,680,800 | 8/1928 | Osean | 362/188 |
| 1,703,749 | 2/1928 | Rahm | 362/188 |
| 1,859,481 | 5/1932 | Voorhees | 362/188 |
| 2,239,928 | 4/1941 | Nixon . | |
| 2,516,993 | 8/1950 | Holt . | |
| 2,945,944 | 7/1960 | Gillespie . | |
| 3,196,268 | 7/1965 | Mack . | |
| 3,603,783 | 9/1971 | Schwartz . | |
| 3,689,759 | 9/1972 | Dill . | |
| 3,875,397 | 4/1975 | Nicholl . | |
| 4,388,673 | 6/1983 | Maglica . | |
| 4,414,612 | 11/1983 | Conforti et al. . | |
| 4,527,223 | 7/1985 | Maglica . | |
| 4,533,984 | 8/1985 | Gatton . | |
| 4,577,263 | 3/1986 | Maglica . | |
| 4,656,565 | 4/1987 | Maglica . | |
| 4,821,156 | 4/1989 | Siefert et al. . | |
| 4,841,417 | 6/1989 | Maglica et al. . | |

*Primary Examiner*—Ira S. Lazarus
*Assistant Examiner*—Richard R. Cole
*Attorney, Agent, or Firm*—Lerner, David, Littenberg, Krumholz & Mentlik

[57] ABSTRACT

An illumination device, for example, a flashlight includes an adjustable beam focus assembly to change the relative position of the lamp bulb to the reflector to alternately provide a narrow focused or wide beam being emitted from the device. The adjustable beam focus assembly includes a resilient blade supporting the lamp bulb extending through an opening in a reflector of the device. Beam focusing is achieved by flexing the blade upon application of a displacing force to the base of the bulb by a cam or to the blade itself using a plunger.

24 Claims, 3 Drawing Sheets

ADJUSTABLE BEAM FOCUS FLASHLIGHT

BACKGROUND OF THE INVENTION

The present invention relates in general to an illumination device such as a flashlight and the like, and more particularly, to such an illumination device having an adjustable beam focus.

Flashlights of varying sizes and shapes are well-known in the art. In particular, certain of these known flashlights utilize two or more dry cell batteries as their source of electrical energy carried in series in a cylindrical housing serving as a handle for the flashlight. The actuation of a switch completes a circuit within the housing to enable electrical current to pass through the filament of a bulb, thereby generating light which is typically focused by a reflector to form a beam of light.

The production of light from such flashlights has often been degraded by the quality of the reflector utilized and the optical characteristics of any lenses interposed in the beam path. Efforts at improving such flashlights have primarily addressed the quality of the optical characteristics. The production of more highly reflective, well-defined reflectors, which may be incorporated within such flashlights have been found to provide a more well-defined focus thereby enhancing the quality of the light being produced.

Since there exists a wide variety of uses for hand-held flashlights, one desirable feature is the capability of adjusting the beam width, i.e., variable focus which produces a beam of light having a variable dispersion. In certain situations it is useful to provide a concentrated beam of light of constant diameter, while in other circumstances, it is desirable for the beam to spread and thereby illuminate a larger area. This has been achieved in the past by selecting the position of the bulb with respect to the parabolic reflector commonly used in flashlights.

The bulb is located at the focus of a parabolic reflector and rays from the bulb are collimated by the reflector to provide a beam which is of substantially constant diameter. On the other hand, a beam that is conical in shape, i.e., one that spreads, has been achieved by moving the bulb so as not to be located at the focus of the reflector. The distance between the bulb location and the focus point will effect the amount of beam spread or dispersion. Flashlights that have had this capability in the past have generally included a large number of components and complicated mechanisms, all of which have rendered these flashlights relatively expensive to manufacture.

Varying the relative position of the bulb with respect to the focus point of the reflector has been achieved by a number of designs. For example, there is known from U.S. Pat. No. 3,689,759 the longitudinal movement of the bulb by means of an internal motor which drives a supporting shaft. U.S. Pat. No. 2,945,944 slides an internal battery casing within its outer housing. U.S. Pat. No. 2,239,928 provides an adjustable threaded rod attached to a bracket supporting the bulb holder. U.S. Pat. No. 4,533,984 provides a central knob which receives the front end of the bulb in a spring biased assembly U.S. Pat. No. 3,603,783 utilizes an exterior magnet which effects a magnetic member which is secured to the bulb housing. U.S. Pat. No. 2,516,993 achieves longitudinal movement of the bulb by means of a slide plate. U.S. Pat. No. 3,875,397 provides a manually rotatable bulb housing. U.S. Pat. No. 4,414,612 achieves longitudinal movement of the bulb housing which is connected to a carriage by means of an externally accessible tab. U.S. Pat. No. 3,196,268 utilizes a switch which when depressed causes a dog to push against a lip resulting in the bulb housing moving rearward U.S. Pat. No. 4,841,417 achieves longitudinal movement of a bulb housing by rotation of a housing tail assembly. Additionally, U.S. Pat. Nos. 4,527,223, 4,577,263, 4,821,156, 4,388,673 and 4,656,565 achieve beam focusing by rotation of a head assembly which supports the parabolic reflector.

Despite the apparent variety of construction details to achieve variable beam focusing in a flashlight, there still remains a need for an internal assembly having few components and which is economical to manufacture.

SUMMARY OF THE INVENTION

One object of the present invention is to provide an adjustable beam focus flashlight having an internal beam focus assembly constructed of relatively few components and adapted for use in a watertight housing to enable use in an underwater environment.

Another object of the present invention is to provide an adjustable beam focus of flashlight which enables variable beam focusing in a simple manner external to the flashlight housing.

Another object of the present invention is to provide an adjustable beam focus flashlight which enables battery replacement without interference from the adjustable beam focus assembly.

In accordance with one embodiment of the present invention, there is provided a flashlight having an adjustable beam focus constructed of a housing containing a reflector, a lamp bulb and an adjustable beam focus assembly, the assembly including a resilient member arranged adjacent the reflector and supporting the bulb, and flexing means for flexing the resilient member between a first and second state whereby the relative position of the bulb to the reflector changes to adjust the beam focus.

In accordance with another embodiment of the present invention, there is provided a flashlight having an adjustable beam focus constructed of a housing containing a reflector having an opening, a lamp bulb and an adjustable beam focus assembly, the assembly including a resilient blade arranged adjacent the reflector and supporting the bulb extending through the opening, and flexing means for flexing the resilient blade between a first and second radius of curvature, the bulb being displaced within the opening during flexing of the blade whereby the relative position of the bulb to the reflector changes to adjust the beam focus.

In accordance with another embodiment of the present invention, there is provided a flashlight having an adjustable beam focus constructed of a housing containing a lens, a reflector adjacent the lens and having an opening, a lamp bulb extending through the opening, a switch for electrically energizing the light bulb and an adjustable beam focus assembly, the assembly including a resilient blade having at least one end secured to the housing, the blade arranged adjacent the opening of the reflector and supporting the bulb, and flexing means for flexing the blade towards and away from the opening of the reflector whereby the relative position of the bulb to the reflector changes to adjust the beam focus.

BRIEF DESCRIPTION OF THE DRAWINGS

The above description, as well as further objects, features and advantages of the present invention will be more fully understood with reference to the following detailed description of an adjustable beam focus flashlight, when taken in conjunction with the accompanying drawings, wherein.

DETAILED DESCRIPTION

Figure 1:
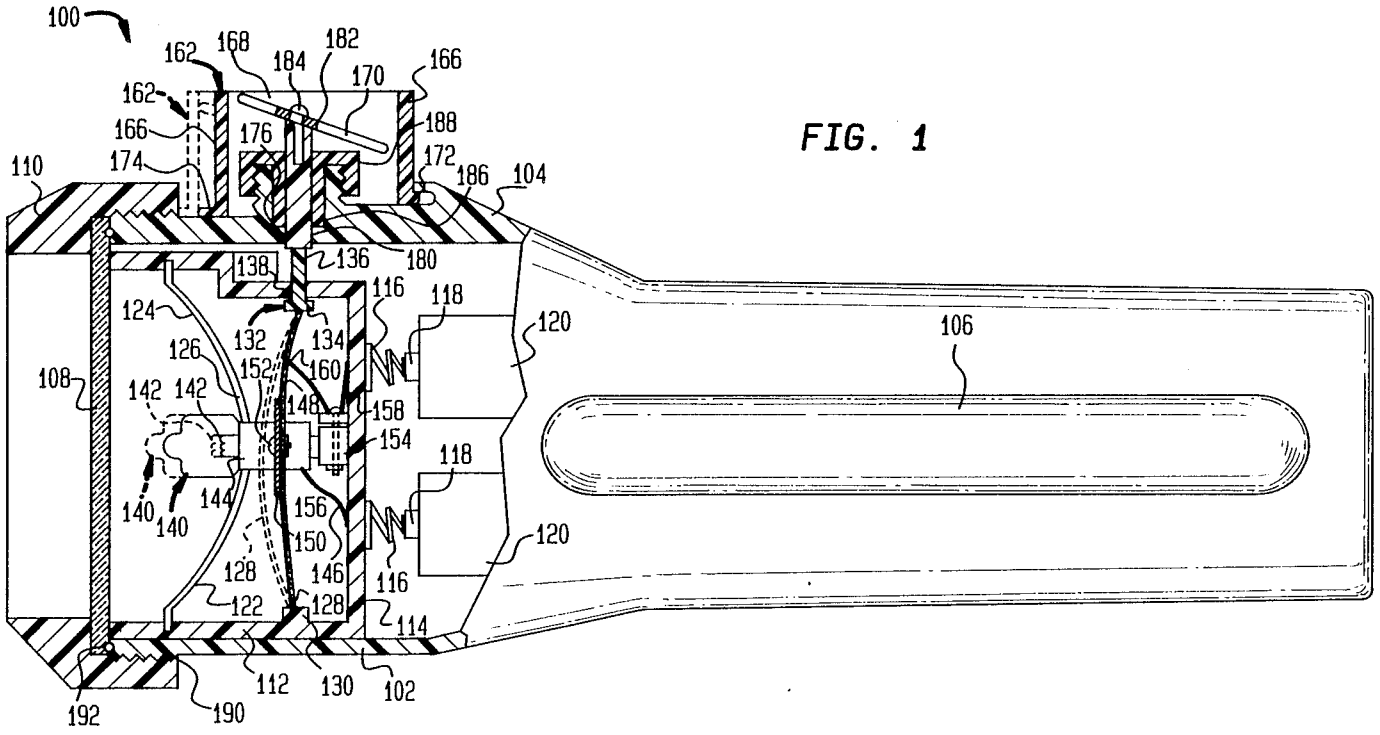
FIG. 1 is a partial cross-sectional view of an adjustable beam focus flashlight showing the beam focus assembly constructed in accordance with one embodiment of the present invention.

Referring now to the drawings wherein like reference numerals represent like elements, there is shown in FIG. 1 a flashlight having an adjustable beam focus and generally designated by reference numeral 100. The flashlight 100 includes a generally elongated cylindrical housing 102 having a hollow interior 104 and supporting an exterior handle 106 as best shown in profile in FIG. 4. The open end of the housing 102 is closed by a circular transparent lens 108 retained by a ring shaped cap 110 having screw threads mating with corresponding screw threads about the open end of the housing. Removably received within the open end of the housing 102 adjacent lens 108 is a generally cylindrical cup-shaped beam focus assembly housing 112. The housing 112 includes a flat base 114 which supports a pair of spaced apart coiled spring electrical contacts 116 which engage the positive terminals 118 of a series of batteries 120 received within the hollow interior 104 of housing 102. The electrical connection to the negative terminal of the batteries 120 is not shown as such connection is conventional in known flashlights. A parabolic reflector 122 having a reflecting surface 124 and a central opening 126 is removably secured about its perimeter to the surrounding wall forming the housing 112.

Figure 2:
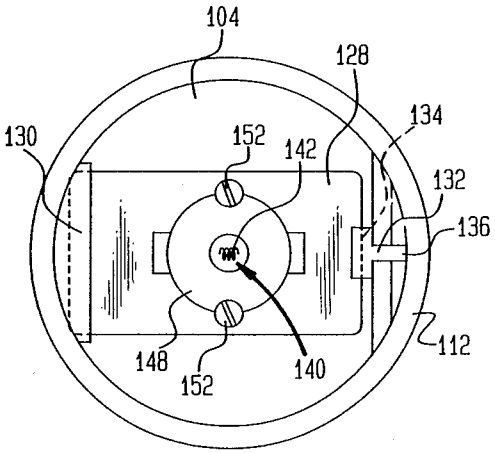
FIG. 2 is a partial front elevational view showing a portion of the beam focus assembly in accordance with the embodiment shown in FIG. 1.

The adjustable beam focus assembly of the present invention will now be described with respect to FIGS. 1 thru 3. A flat generally rectangular flexible blade 128 is arranged within the beam focus assembly housing 112 underlying the opening 126 within the reflector 122. The blade 128 is formed from a resilient material, such as spring steel, whereby the blade may be distorted or flexed upon application of a deforming force and, upon removal of the applied deforming force, the blade will return to its original shape. One narrow end of the blade 128 is retained within a groove formed within a projection 130 extending inwardly from a side wall of the housing 112. The other narrow end of the blade 128 is retained by a T-shaped plunger 132. The plunger 132 includes an enlarged head 134 having a groove for retaining the end of the blade 128 and an elongated shaft 136 slidably extending through an opening 138 within a side wall of the housing 112. As shown in FIG. 1, the distance between projection 130 and the head 134 of the plunger 132 is such that the blade 128 has a slight initial curvature or bow shape. However, it is also contemplated that the initial shape of the blade 128 may be generally planar, although a slight curvature or bow shape is preferred.

A lamp bulb 140 includes a filament 142, a cylindrical metal base 144, an external electrical lead 146 and a generally circular flat metal flange 148 secured transverse to the base at a position about midway therealong. The flange 148 of the bulb 140 acts as a second electrical lead for supplying power to the bulb as will be clear from the further description of the present invention.

The base 144 of the bulb 140 freely extends through the opening 126 of the reflector 122 to an extent such that the filament 142 remains displaced from the reflecting surface 122, e.g., at the focal point of the reflector. The length of the base 144 is such to extend through an opening 150 provided within a central portion of the blade 128 and to extend a short distance therebeyond. The flange 148 of the bulb 140 rests on the outwardly curved side of the blade 128 and is secured thereto by means of a pair of spaced apart screws 152. The screws 152 are arranged along the short axis of the blade 128 to minimize their inhibitory effect upon the flexing of the blade during focusing of the beam being emitted from the bulb 140 pursuant to the present invention.

A microswitch 154 having a contact plunger 156 is secured to the base 114 of the housing 112 centrally underlying the bulb 140. In this regard, the plunger 156 extends outwardly into contact with the bottom of the base 144 of the bulb 140. An electrical circuit is completed through the microswitch 154 by means of an electrical lead 158 connected to one of the battery contacts 116 and another electrical lead 160 connected between the microswitch and the blade 128. As thus far described, electrical power to the bulb 140 being supplied by the batteries 120 is controlled by operation of the microswitch 154.

Figure 3:
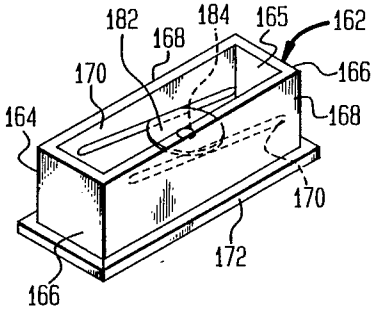
FIG. 3 is a perspective view of the exterior slide switch shown in FIG. 1.

As best shown in FIGS. 1 and 3, a beam focus switch 162 is slidably mounted to the exterior of housing 102 adjacent cap 110. The switch 162 is formed from a generally rectangular body 164 having a hollow rectangular interior 165 formed between a pair of spaced apart end walls 166 and a pair of spaced apart side walls 168. The interior surface of the side walls 168 are each provided with an elongated groove 170 arranged in alignment with each other and at an incline to the longitudinal axis of the beam focus assembly housing 112. A lip 172 is provided around the base of the end walls 166 and side walls 168. The housing 102 is constructed to include a pair of spaced apart arms 174 which are positioned overlying the lip 172 such that the switch 162 is slidingly retained on the housing. The lateral displacement of the switch 162 is limited by the lip 172 extending from the end walls 162 upon its engagement with a portion of the housing 102 when displaced to the right in FIG. 1 and by the end of cap 110 when displaced to the left.

An opening 176 is provided within the housing 102 in alignment with the shaft 136 of the plunger 132. An annular shaped externally threaded boss 178 extends outwardly from the housing 102 surrounding the opening 176. An elongated cylindrical shaft 180 ext ends through the opening 176 within the housing 102, through the center of the boss 178 and into the hollow interior 165 of the switch 162. The shaft 180 terminates at a sloped end to which there is fastened a circular retaining washer 182 by means of a screw 184. The diameter of the washer 182 is such that opposing portions thereof are received within the grooves 170 formed within the interior surfaces of the side walls 168 of the switch 162.

A water-tight seal is formed about shaft 180 where it is received within opening 176 of the housing 102 by means of an O-ring 186 which is compressed thereabout by a annular U-shaped gland 188 which is threadably secured to the boss 178. The flashlight is further rendered water-tight by means of an O-ring 190 arranged between the housing 102 and cap 110 and an O-ring 192 arranged between the housing and the lens 108. As a result of this water-tight construction, the flashlight 100 is particularly suitable for use in an underwater environment.

The operation of the flashlight 100 to provide an adjustable beam focus will now be described with reference to FIG. 1. The beam of the flashlight 100 may be adjusted between narrow and wide beam focusing by lateral movement of the switch 162 between its position shown in solid lines and that shown in dashed lines. The flashlight 100 is turned on by initially moving the switch 162 slightly to the right as shown in FIG. 1. As a result, shaft 180 is withdrawn outwardly of housing 102 through opening 176 by virtue of washer 182 being captured between the advancing inclined grooves 170. The outward movement of shaft 180 allows for a corresponding outward movement of plunger 132 and a slight flattening or decrease in the radius of curvature of blade 128. As the blade 128 tends to flatten, the base 144 of the bulb 140 depresses the contact plunger 156 of the microswitch 154 completing the electrical circuit to apply power from the batteries 120 to the bulb. Once the flashlight 100 is turned on, the switch 162 may be left in such position or moved slightly to the left to its original position shown in solid lines, either position providing a substantially focused beam. When it is desired to shut the flashlight 100 off, the switch 162 is slightly moved once again to the right to depress the plunger 156 of the microswitch 154 thereby breaking electrical continuity with the batteries 120.

The beam focus is adjustable to obtain a wide or dispersed beam by moving the switch 162 to the left, as shown in FIG. 1, into the position indicated generally by the dashed lines. As switch 162 is moved to the left, shaft 180 is extended through opening 176 into the interior 104 of the housing 102 by means of washer 182 being retained within the advancing inclined grooves 170. As shaft 180 is displaced inwardly, the shaft engages the shaft 136 of the plunger 132 causing its corresponding movement through opening 138 inwardly of the housing 112. As the plunger 132 is depressed radially inward, the resulting force applied to the end of the blade 128 causes the blade to flex or bow outwardly to the left, as shown in dashed lines, to attain a greater radius of curvature. This bowing or flexing of the blade 128 causes the bulb 140 to be displaced longitudinally through the opening 126 within the reflector 122 to the position as shown in dashed lines. As a result, the filament 142 of the bulb 140 is positioned further from the reflecting surface 124 of the reflector 122 to provide a dispersed or wide beam of light, i.e., not at the focal point of the reflector. The beam focus may be subsequently adjusted to provide a focused beam by displacing the switch 162 to the right as shown in solid lines in FIG. 1. The flashlight 100 is turned off by moving the switch 162 slightly further to the right from the position shown to once again depress the contact plunger 156 of the microswitch 154. As a result of the resilient and spring-like nature of the blade 128, the blade may be bowed or flexed between its position shown in dashed and solid lines to achieve beam focusing simply by movement of the switch 162.

Figure 5:
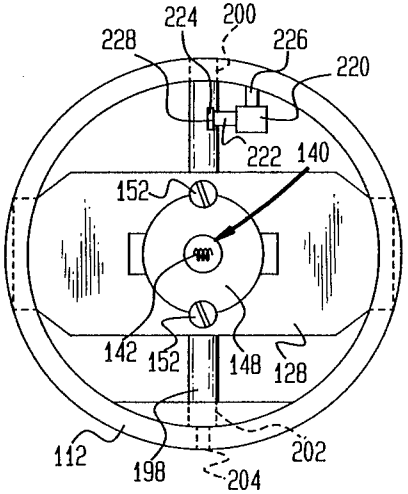
FIG. 5 is a partial front elevational view showing a portion of the beam focus assembly in accordance with the embodiment shown in FIG. 4.
Figure 4:
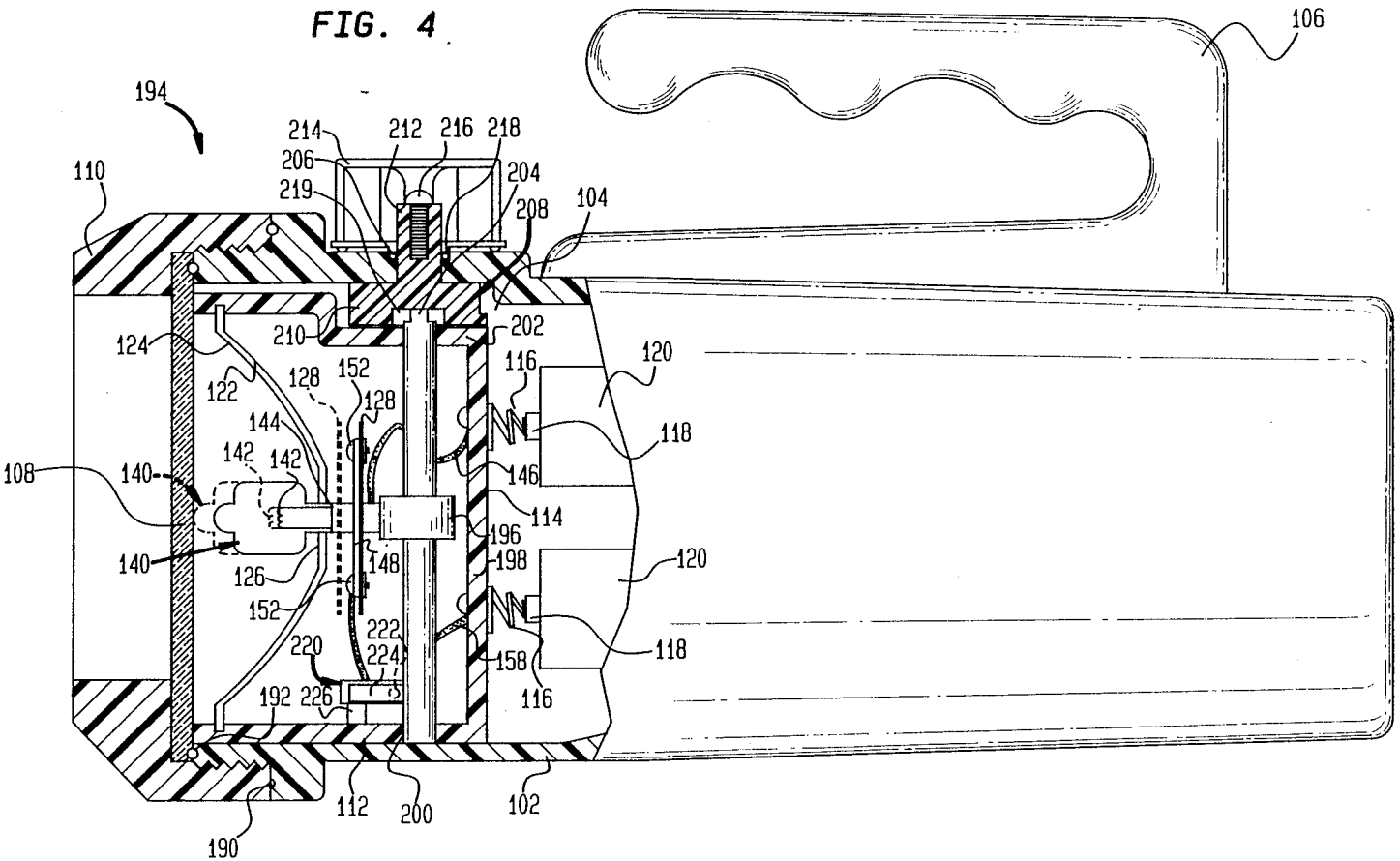
FIG. 4 is a partial cross-sectional view of the adjustable beam focus flashlight showing the beam focus assembly constructed in accordance with another embodiment of the present invention.

Referring now to FIGS. 4 and 5, a flashlight 194 constructed in accordance with another embodiment of the present invention will now be described. Other than the adjustable beam focus assembly, the flashlight 194 is constructed in a similar manner to the flashlight 100. Accordingly, the general construction of the flashlight 194 will not be described and any explanation as to such construction may be obtained with respect to the flashlight 100 as previously described. The beam focusing assembly of flashlight 194 includes a generally cylindrical cam 196 eccentrically mounted to a rotatable shaft 198. The shaft 198 is journaled for rotation at its ends by being received within openings 200, 202 provided within the side wall forming the beam focus assembly housing 112. The cam 196 is arranged so as to be in engagement at all times with the bottom of the base 144 of the bulb 140. One end of the shaft 198 extends through the opening 202 in the side wall of the housing 112 and terminates in the form of a rectangular projection 204. Opposing the rectangular projection 204 there is provided an opening 206 within the housing 102. A T-shaped rotatable insert 208 includes a generally cylindrical head 210 arranged between housing 112 and housing 102 and a shaft 212 extending outwardly through opening 206. A knob 214 is secured to the end of the shaft 212 by means of a screw 216. An O-ring 218 is arranged about the shaft 212 to form a watertight seal thereat upon compression against the housing 102 by means of the knob 214. The head 214 of the insert 208 is circumferentially provided with an enlarged opening 219 which reduces towards the central portion thereof to a rectangular shaped opening for matingly receiving the rectangular projection 214 provided at the end of shaft 198. As a result of this construction, rotation of knob 214 will effect rotation of shaft 198 and cam 196.

Adjacent the other end of the shaft 198, there is provided a microswitch 220 having a contact plunger 222 and a pivotable action lever 224. The microswitch 220 is mounted to the inside wall of the housing 112 by means of a standoff 226. As best shown in FIG. 5, the lever 224 of the microswitch 220 is arranged in sliding contact with the shaft 198 at a portion thereof which has been notched out to provide a flat bottom groove 228. This portion of the shaft 198 acts as a cam to open and close the microswitch 220 as the lever 224 alternately contacts the cylindrical portion and groove 228 of the shaft during its rotation by means of knob 214. The microswitch 220 is electrically connected to the batteries 120 and bulb 140 in the manner previously described with respect to the flashlight 100.

Focusing of the flashlight 194 is achieved by rotation of knob 214 which initially activates microswitch 220 and subsequently displaces the bulb 140 against the spring like action of blade 128 longitudinally through the opening 126 within the reflector 122 by engagement of its base 144 with the outer surface of cam 196. The light bulb 140, when in the position shown in solid lines, results in a focused beam. On the other hand, displacement of the bulb to the position shown in dashed lines by further rotation of cam 196 results in a dispersion of the beam as it is reflected from the reflecting surface 124 of the reflector 122. As the flange 148 of the bulb 140 is secured to the blade 128, the displacement of the bulb to the left, as shown in FIG. 4, causes flexing or bowing of the blade to its position shown in dashed lines. The blade 128 in the flashlight 194 functions in the same manner as the blade being utilized in the flashlight 100 as described with reference to FIG. 1. In addition, rotation of shaft 198 causes operation of the microswitch 220 in a similar manner as the operation of microswitch 154.

There has thus far been described a flashlight 100, 194 having an adjustable beam focus assembly having a minimum number of components and particularly suitable for use in a flashlight for use in an underwater environment. The components of the flashlight 100,194 may, for the most part, be constructed from plastic material. The primary components of the adjustable beam focus assembly is arranged within a beam focus assembly housing 112 received within the open end of the housing 102. In this regard, the batteries 120 may be easily replaced upon removal of the housing 112 after unscrewing the cap 110 and removal of lens 108. Based upon the aforementioned description, the switch 162 and knob 214 need not be removed when removing the housing 112 for battery replacement.

Although the invention herein has been described with references to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. An illumination device having an adjustable beam focus comprising a housing containing a reflector, a lamp bulb and an adjustable beam focus assembly, said assembly including a resilient member arranged adjacent said reflector and supporting said bulb, and flexing means for flexing said resilient member between a first and second state, said flexing means comprising a rotatable cam in contact with a portion of said bulb, the rotation of said cam causing said resilient member to flex to a greater or lesser amount between said first and second states thereby changing the relative position of said bulb to said reflector to adjust the beam focus.

2. The illumination device of claim 1, wherein said resilient member comprises a blade flexed to have a curved profile.

3. The illumination device of claim 1, further including a switch for electrically energizing said bulb.

4. The illumination device of claim 3, wherein said flexing means includes a shaft supporting said cam for rotation, said shaft having a portion operative of said switch upon rotation of said shaft, and means exterior of said housing for rotation of said shaft.

5. The illumination device of claim 1, further including means for supplying electrical energy to said bulb.

6. An illumination device having an adjustable beam focus comprising a housing containing a reflector having an opening, a lamp bulb and an adjustable beam focus assembly, said assembly including a resilient blade arranged adjacent said reflector and supporting said bulb extending through said opening, and flexing means for flexing said resilient blade between a first and second radius of curvature, said flexing mans comprises a rotatable cam in contact with a portion of said bulb, the rotation of said cam causing said blade to flex to a greater or less amount thereby changing the relative position of said bulb to said reflector, said bulb being displaced within said opening during flexing of said blade whereby the relative position of said bulb to said reflector changes to adjust the beam focus.

7. The illumination device of claim 6, further including a switch for electrically energizing said bulb.

8. The illumination device of claim 7, wherein said flexing means includes a shaft supporting said cam for rotation, said shaft having a portion operative of said switch upon rotation of said shaft, and means exterior of said housing for rotation of said shaft.

9. An illumination device having an adjustable beam focus comprising a housing containing a lens, a reflector adjacent said lens and having an opening, a lamp bulb extending through said opening, a switch for electrically energizing said light bulb and an adjustable beam focus assembly, said assembly including a resilient blade having at least one end secured to said housing, said blade arranged adjacent said opening of said reflector and supporting said bulb, and flexing means for flexing said blade towards and away from said opening of said reflector, said flexing means comprises a rotatable cam in contact with a portion of said bulb, the rotation of said cam causing said blade to flex to a greater or lesser amount thereby changing the relative position of said bulb to said reflector to adjust the beam focus.

10. The illumination device of claim 9, wherein said resilient blade is initially flexed to have a curved profile.

11. The illumination device of claim 9, wherein said flexing means includes a shaft supporting said cam for rotation, said shaft having a portion operative of said switch upon rotation of said shaft, and means exterior of said housing for rotation of said shaft.

12. An illumination device having an adjustable beam focus comprising a housing containing a reflector, a lamp bulb and an adjustable beam focus assembly, said assembly including a resilient member arranged adjacent said reflector and supporting said bulb, and flexing means for flexing said resilient member between a first and second state whereby the relative position of said bulb to said reflector changes to adjust the beam focus, one end of said resilient member retained by a portion of said flexing means.

13. The illumination device of claim 12, wherein said flexing means comprising a plunger movable within said housing and means operative for causing movement of said plunger in a direction which causes said resilient member to flex to a greater or lesser amount between said first and second states thereby changing the relative position of said bulb to said reflector to adjust the beam focus.

14. The illumination device of claim 13, wherein said means comprises a body having an opening formed between a pair of spaced apart walls, a pair of spaced apart inclined grooves formed within said walls, a shaft received within said opening, one end of said shaft engaging said grooves and the other end of said shaft extending into said housing into engagement with said plunger, whereby the movement of said body causes inward and outward movement of said plunger by corresponding movement of said shaft to flex said resilient member thereby changing the relative position of said bulb to said reflector.

15. The illumination device of claim 12, wherein said resilient member comprises a blade flexed to have a curved profile.

16. An illumination device having an adjustable beam focus comprising a housing containing a reflector having an opening, a lamp bulb and an adjustable beam focus assembly, said assembly including a resilient blade arranged adjacent said reflector and supporting said bulb extending through said opening, and flexing means for flexing said resilient blade between a first and second radius of curvature, said bulb being displaced within said opening during flexing of said blade whereby the relative position of said bulb to said reflector changes to adjust the beam focus, one end of said blade retained by a portion of said flexing means.

17. The illumination device of claim 16, wherein said flexing means comprising a plunger movable within said housing and means operative for causing movement of said plunger in a direction which causes said blade to flex to a greater or lesser amount thereby changing the relative position of said bulb to said reflector to adjust the beam focus.

18. The illumination device of claim 17, wherein said means comprises a body having an opening formed between a pair of spaced apart walls, a pair of spaced apart inclined grooves formed within said walls, a shaft received within said opening, one end of said shaft engaging said grooves and the other end of said shaft extending into said housing into engagement with said plunger, whereby the movement of said body causes inward and outward movement of said plunger by corresponding movement of said shaft to flex said blade thereby changing the relative position of said bulb to said reflector.

19. An illumination device having an adjustable beam focus comprising a housing containing a lens, a reflector adjacent said lens and having an opening, a lamp bulb extending through said opening, a switch for electrically energizing said light bulb and an adjustable beam focus assembly, said assembly including a resilient blade having at least one end secured to said housing, said blade arranged adjacent said opening of said reflector and supporting said bulb, and flexing means for flexing said blade towards and away from said opening of said reflector, said flexing means comprising a plunger movable within said housing and means operative for causing movement of said plunger in a direction which causes said blade to flex to a greater or lesser amount thereby changing the relative position of said bulb to said reflector to adjust the beam focus.

20. The illumination device of claim 19, wherein said means comprises a body having an opening formed between a pair of spaced apart walls, a pair of spaced apart inclined grooves formed within aid walls, a shaft received within said opening, one end of said shaft engaging said grooves and the other end of said shaft extending into said housing into engagement with said plunger, whereby the movement of said body causes inward and outward movement of said plunger by corresponding movement of said shaft to flex said blade thereby changing the relative position of said bulb to said reflector.

21. An illumination device having an adjustable beam focus comprising a housing having a battery compartment, said housing containing a reflector, a lamp bulb, a battery within said battery compartment and electrically connected to said bulb, and an adjustable beam focus assembly, said assembly including a resilient blade arranged adjacent said reflector and supporting said bulb, and flexing means for flexing said resilient blade between a first and second state while said battery within said battery compartment remains stationary whereby the relative position of said bulb to said reflector changes to adjust the beam focus.

22. The illumination device of claim 21, wherein said flexing means comprises a rotatable cam in contact with a portion of said bulb, the rotation of said cam causing said blade to flex to a greater or lesser amount thereby changing the relative position of said bulb to said reflector to adjust the beam focus.

23. The illumination device of claim 21, wherein said flexing means comprising a plunger movable within said housing and means operative for causing movement of said plunger in a direction which causes said blade to flex to a greater or lesser amount thereby changing the relative position of said bulb to said reflector to adjust the beam focus.

24. The illumination device of claim 21, wherein said resilient blade is initially flexed to have a curved profile.

* * * * *

UNITED STATES PATENT AND TRADEMARK OFFICE

CERTIFICATE OF CORRECTION

PATENT NO. : 4,987,523

DATED : January 22, 1991

INVENTOR(S) : Lindabury et al.

It is certified that error appears in the above-identified patent and that said Letters Patent is hereby corrected as shown below:

Column 7, line 66, "mans" should read --means--.
Column 10, line 7, "aid" should read --said--.

Signed and Sealed this

Twenty-first Day of July, 1992

*Attest:*

DOUGLAS B. COMER

*Attesting Officer*

*Acting Commissioner of Patents and Trademarks*